US009371737B2

(12) United States Patent
Hashimoto

(10) Patent No.: US 9,371,737 B2
(45) Date of Patent: Jun. 21, 2016

(54) GAS TURBINE

(75) Inventor: Shinya Hashimoto, Tokyo (JP)

(73) Assignee: MITSUBISHI HITACHI POWER SYSTEMS, LTD., Yokohama-shi, Kanagawa (JP)

( * ) Notice: Subject to any disclaimer, the term of this patent is extended or adjusted under 35 U.S.C. 154(b) by 951 days.

(21) Appl. No.: 13/597,987

(22) Filed: Aug. 29, 2012

(65) Prior Publication Data

US 2013/0223985 A1 Aug. 29, 2013

(30) Foreign Application Priority Data

Feb. 23, 2012 (JP) ..... 2012-037720

(51) Int. Cl.

| | |
|---|---|
| ***F01D 11/00*** | (2006.01) |
| ***F01D 11/04*** | (2006.01) |
| ***F01D 25/18*** | (2006.01) |
| ***F01D 9/06*** | (2006.01) |

(52) U.S. Cl.

CPC ..... *F01D 11/001* (2013.01); *F01D 9/065* (2013.01); *F01D 11/04* (2013.01); *F01D 25/183* (2013.01)

(58) Field of Classification Search

CPC ..... F01D 5/085; F01D 5/087; F01D 9/065; F01D 25/12; F01D 25/125

See application file for complete search history.

(56) References Cited

U.S. PATENT DOCUMENTS

| | | | | |
|---|---|---|---|---|
| 2009/0324386 | A1* | 12/2009 | Takamura et al. | 415/115 |
| 2011/0020116 | A1* | 1/2011 | Hashimoto et al. | 415/180 |

FOREIGN PATENT DOCUMENTS

| | | | |
|---|---|---|---|
| CN | 1127327 | A | 7/1996 |
| CN | 101743391 | A | 6/2010 |
| CN | 102076940 | A | 5/2011 |
| EP | 1 108 858 | A2 | 6/2001 |
| EP | 1 233 147 | A2 | 8/2002 |
| EP | 2 148 977 | B1 | 8/2010 |
| EP | 2 309 109 | A1 | 4/2011 |
| JP | 08-100674 | A | 4/1996 |
| JP | 09-256815 | A | 9/1997 |
| JP | 11-101131 | A | 4/1999 |
| JP | 2001-182503 | A | 7/2001 |
| JP | 2002-242606 | A | 8/2002 |
| JP | 2007-146755 | A | 6/2007 |

(Continued)

OTHER PUBLICATIONS

English translation of the Written Opinoin of PCT/JP2012/072014, mailng date of Oct. 23, 2012 (5 pages).

Notice of Reasons for Rejection dated Apr. 7, 2015, issued in corresponding Japanese Patent Application No. 2014-500856 with English translation (3 pages).

International Search Report of PCT/JP2012/072014, mailing date of Oct. 23, 2012, w/English translation.

(Continued)

*Primary Examiner* — Nathaniel Wiehe
*Assistant Examiner* — Cameron Corday
(74) *Attorney, Agent, or Firm* — Westerman, Hattori, Daniels & Adrian, LLP

(57) ABSTRACT

A gas turbine includes: a cooling air pipe disposed at a downstream side of a rotor main body without contacting with the rotor main body and configured to feed cooling air into a cooling air main passage of the rotor main body; a bearing downstream end shaft seal annularly disposed at an outer circumferential side of the rotor main body and at a downstream side of a bearing which rotatably supports the rotor main body; and a collecting flow passage member having a leaked air collecting flow passage that guides the cooling air, which is leaked from the bearing downstream end shaft seal to the bearing side, into an exhaust flow passage through which a combustion gas passing through a final blade stage flows.

4 Claims, 4 Drawing Sheets

(56) References Cited

FOREIGN PATENT DOCUMENTS

| | | | |
|---|---|---|---|
| JP | 2010-527421 | A | 8/2010 |
| WO | 01/38707 | A1 | 5/2001 |
| WO | WO 0138707 | A1 * | 5/2001 |
| WO | 2009/087847 | A1 | 7/2009 |
| WO | 2010/001655 | A1 | 1/2010 |

OTHER PUBLICATIONS

Japanese Written Opinion of PCT/JP2012/072014, mailing date of Oct. 23, 2012.

Chinese Office Action dated Aug. 24, 2015, issued in counterpart Chinese Patent Application No. 201280067375.9, with Partial English translation (7 pages).

* cited by examiner

GAS TURBINE

BACKGROUND OF THE INVENTION

1. Technical Field

The present invention relates to a gas turbine, and more particularly, to a structure around a bearing of a gas turbine.

This application claims priority to and the benefit of Japanese Patent Application No. 2012-037720 filed on Feb. 23, 2012, the disclosures of which are incorporated by reference herein.

2. Description of the Related Art

A gas turbine includes a compressor, a combustor, and a turbine. The compressor compresses external air to generate compressed air. The combustor mixes a fuel with the compressed air to combust them, generating a combustion gas. The turbine has a rotor rotated by the combustion gas. The rotor generally has a rotor main body and a plurality of blade stages. The rotor main body extends in an axial direction parallel to the rotation axis. The plurality of blade stages is fixed to an outer circumference of the rotor main body to be arranged in the axial direction.

In the above-mentioned gas turbine, with increasing efficiency, a temperature of the combustion gas supplied to the turbine is increased to an extremely high temperature. For this reason, most components of the turbine are parts to be cooled, and a final blade stage of the rotor is also a part to be cooled.

A gas turbine in which a final blade stage is cooled, for example, is disclosed in the following Patent Document 1. A cooling air main passage opened at a downstream end of the rotor main body and extending in the axial direction is formed at the rotor main body of the gas turbine, and a blade cooling air passage configured to introduce cooling air supplied through the cooling air main passage into the final blade stage is formed at the rotor main body. A cooling air pipe not in contact with the rotor main body is disposed at a downstream side of the rotor main body. Compressed air extracted from the compressor via the cooling air pipe is supplied into the cooling air main passage of the rotor main body as cooling air. That is, in the gas turbine, as the compressed air extracted from the compressor is fed to the final blade stage via the cooling air pipe and the rotor main body as the cooling air, the final blade stage is cooled.

Here, in the gas turbine, a downstream side seal retaining ring configured to cover an outer circumferential side of the rotor main body is installed at a downstream side of a bearing configured to rotatably support the rotor main body, and a shaft seal is installed at an inner circumferential side of the downstream side seal retaining ring.

A temperature of the compressed air extracted from the compressor is raised by adiabatic compression in the compressor. The compressed air has a sufficiently low temperature to cool a blade but a relatively high temperature for the bearing of the rotor. For this reason, when the bearing of the rotor is exposed to the compressed air, the bearing may be heated, which causes trouble. Here, in the gas turbine, the shaft seal is disposed at the downstream side of the bearing, and a portion of the compressed air extracted from the compressor is prevented from flowing to the bearing side through a gap between the rotor main body and the cooling air pipe.

RELATED ART DOCUMENT

Patent Document

[Patent Document 1] PCT Application Laid-open No. 2010/001655

SUMMARY OF THE INVENTION

Problems to be Solved by the Invention

In the technique disclosed in Patent Document 1, as described above, the shaft seal is disposed to prevent a portion of the compressed air extracted from the compressor from flowing to the bearing side. However, in the technique disclosed in Patent Document 1, the bearing is heated by the compressed air leaked from the shaft seal to the bearing side, and trouble may occur with the bearing.

Here, in order to solve the problems, it is an object of the present invention to provide a gas turbine capable of preventing the bearing of the rotor from being heated.

Means for Solving the Problems

In order to accomplish the object, the present invention provides a gas turbine including a rotor rotated around a rotation axis by a combustion gas, and a bearing rotatably supporting a portion of a downstream side of the rotor, wherein the rotor has a rotor main body extending in an axial direction parallel to the rotation axis of the rotor, and a plurality of blade stages fixed to an outer circumference of the rotor main body and arranged in the axial direction, and a cooling air main passage opened at a downstream end of the rotor main body and extending in the axial direction is formed at the rotor main body, and the gas turbine includes: a cooling air pipe disposed at a downstream side of the rotor main body without contacting with the rotor main body and configured to feed cooling air into the cooling air main passage of the rotor main body; a bearing downstream end shaft seal annularly disposed at the outside of the rotor main body in a radial direction and at the downstream side of the bearing; and a collecting flow passage member having a leaked air collecting flow passage that guides the cooling air, which reaches to the bearing downstream end shaft seal from a clearance between the downstream end of the rotor main body and the cooling air pipe via the outside of the rotor main body in the radial direction and is leaked from the bearing downstream end shaft seal to the bearing side, into an exhaust flow passage through which the combustion gas passing through a final blade stage among the plurality of blade stages flows.

In the gas turbine according to the present invention, compressed air extracted from a compressor of the gas turbine is supplied into the cooling air pipe as the cooling air. The cooling air passes through the cooling air main passage of the rotor main body from the cooling air pipe to be guided to, for example, a blade, and the cooling air cools the blade.

In the gas turbine according to the present invention, since the rotating rotor is not in contact with the cooling air pipe, which does not rotate, a portion of the cooling air supplied from the cooling air pipe into the cooling air main passage of the rotor main body enters the outer circumferential side of the rotor main body from the downstream end of the rotor main body. The compressed air extracted from the compressor as the cooling air has a sufficiently low temperature to cool the blade but a relatively high temperature for the bearing of the rotor. For this reason, when the bearing is exposed to the cooling air, the bearing is heated and it causes trouble in the bearing.

Accordingly, in the gas turbine according to the present invention, as the bearing downstream end shaft seal is installed at a downstream side of the bearing, the cooling air entering the outer circumferential side of the rotor main body is prevented from flowing to the bearing side. However, similar to the bearing downstream end shaft seal, a seal leakage occurs between a rotating body and a stationary body due to imperfect sealing therebetween. For this reason, in the gas turbine according to the present invention, a portion of the cooling air is leaked from the bearing downstream end shaft seal to the bearing side.

Here, in the gas turbine according to the present invention, the leaked air collecting flow passage is formed, and leaked cooling air, which is a portion of the cooling air leaked from the bearing downstream end shaft seal to the bearing side is guided into the exhaust flow passage through which the combustion gas passing through the final blade stage flows. For this reason, in the gas turbine according to the present invention, it is possible to prevent the bearing from being heated by the compressed air extracted from the compressor as the cooling air.

Here, the gas turbine may include an outer diffuser disposed at a downstream side of the final blade stage and having a tubular shape around the rotation axis; and an inner diffuser having a tubular shape around the rotation axis and disposed at the inside of the outer diffuser in a radial direction and the outside of the rotor main body in a radial direction, so that the exhaust flow passage is formed between the outer diffuser and the inner diffuser, wherein the leaked air collecting flow passage guides the leaked cooling air from the inside in the radial direction of the inner diffuser into the exhaust flow passage.

In the gas turbine according to the present invention, the leaked air collecting flow passage can be reduced in length, rather than discharging the leaked cooling air from the outside in the radial direction of the outer diffuser into the exhaust flow passage. For this reason, in the gas turbine according to the present invention, equipment cost can be suppressed. Further, in the gas turbine according to the present invention, as the leaked air collecting flow passage is reduced in length, pressure loss of the cooling air passing through the flow passage is reduced. For this reason, even when the pressure of the compressed air extracted from the compressor as the cooling air is not increased, the cooling air leaked from the bearing downstream end shaft seal can be collected.

In addition, in the gas turbine, the leaked air collecting flow passage may guide the leaked cooling air to an upstream side of the inner diffuser.

In the gas turbine, pressure (static pressure) at a position of the upstream side of the inner diffuser, which is the downstream side of the final blade stage in the exhaust flow passage, i.e., an inlet section of the exhaust flow passage, is a slightly negative pressure. In the gas turbine according to the present invention, the cooling air leaked from the bearing downstream end shaft seal to the bearing side is discharged into the inlet section of the exhaust flow passage. For this reason, in the gas turbine according to the present invention, in order to collect the cooling air leaked from the bearing downstream end shaft seal to the bearing side, even when the pressure of the compressed air extracted from the compressor as the cooling air is not increased, the leaked cooling air can be collected.

In addition, the gas turbine may include a downstream side seal retaining ring having a tubular shape around the rotation axis, configured to cover a portion of the rotor main body at a downstream side of the bearing, and provided with the bearing downstream end shaft seal at the inside thereof in the radial direction; and a bearing-side downstream side shaft seal disposed at the inside of the downstream side seal retaining ring in the radial direction, the downstream side of the bearing, and the upstream side of the bearing downstream end shaft seal, wherein a through-hole, which penetrates through the downstream side seal retaining ring from the inside thereof in the radial direction to the outside thereof in the radial direction, is formed at a position between the bearing downstream end shaft seal and the bearing-side downstream side shaft seal in the axial direction, and the through-hole forms a portion of the leaked air collecting flow passage. In this case, the collecting flow passage member may have a leaked air collecting pipe in which a flow passage in communication with the through-hole of the downstream side seal retaining ring is formed.

In the gas turbine according to the present invention, the bearing-side downstream side shaft seal is installed at a downstream side of the bearing and an upstream side of the bearing downstream end shaft seal, and the cooling air leaked from the bearing downstream end shaft seal flows into the leaked air collecting flow passage at the downstream side of the bearing-side downstream side shaft seal. For this reason, it is possible to substantially perfectly prevent the leaked cooling air from flowing into the bearing.

Effect of the Invention

According to the present invention, it is possible to prevent the bearing from being heated by the compressed air extracted from the compressor as the cooling air.

MODES FOR CARRYING OUT THE INVENTION

Hereinafter, an embodiment of a gas turbine according to the present invention will be described in detail with reference to FIGS. 1 to 4.

Figure 1:
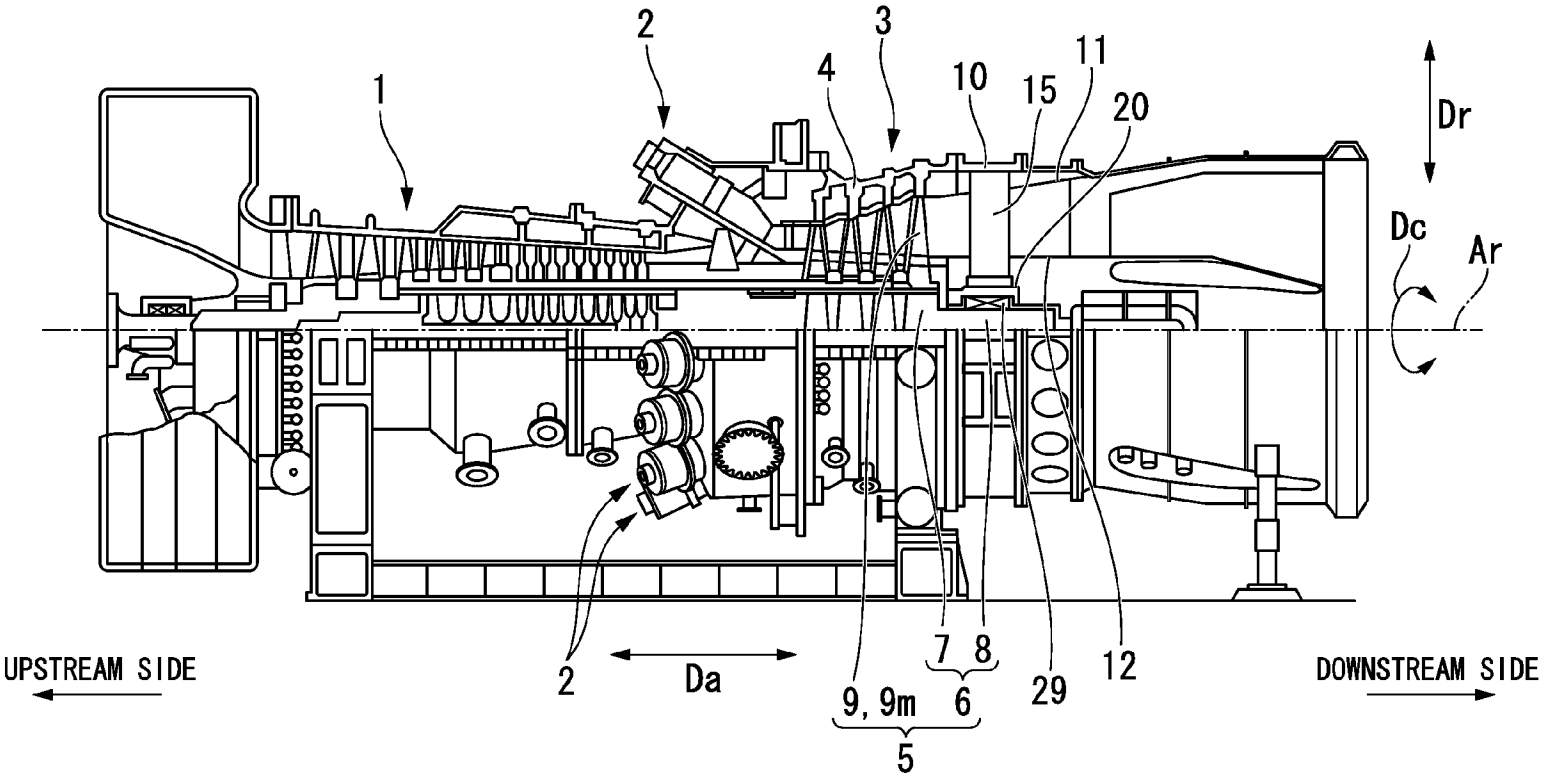
FIG. 1 is a cut-out side view of major parts of a gas turbine according to an embodiment of the present invention.

As shown in FIG. 1, the gas turbine of the embodiment includes a compressor 1, a plurality of combustors 2, and a turbine 3. The compressor 1 compresses external air to generate compressed air. The plurality of combustors 2 mixes fuel from a fuel supply source with the compressed air to combust them, generating a combustion gas. The turbine 3 is driven by the combustion gas.

The turbine 3 includes a casing 4, and a turbine rotor 5 rotated in the casing 4. For example, the turbine rotor 5 is connected to a generator (not shown) configured to generate power by rotation of the turbine rotor 5. The plurality of combustors 2 is fixed to the casing 4 at regular intervals to each other in a circumferential direction Dc around a rotation axis Ar of the turbine rotor 5. In addition, as will be described below, a direction parallel to the rotation axis Ar is simply referred to as an axial direction Da, and a radial direction with respect to the rotation axis Ar is simply referred to as a radial direction Dr. In addition, in the axial direction Da, the compressor 1 side with respect to the turbine 3 is referred to as an upstream side and the turbine 3 side with respect to the compressor 1 is referred to as a downstream side.

Figure 2:
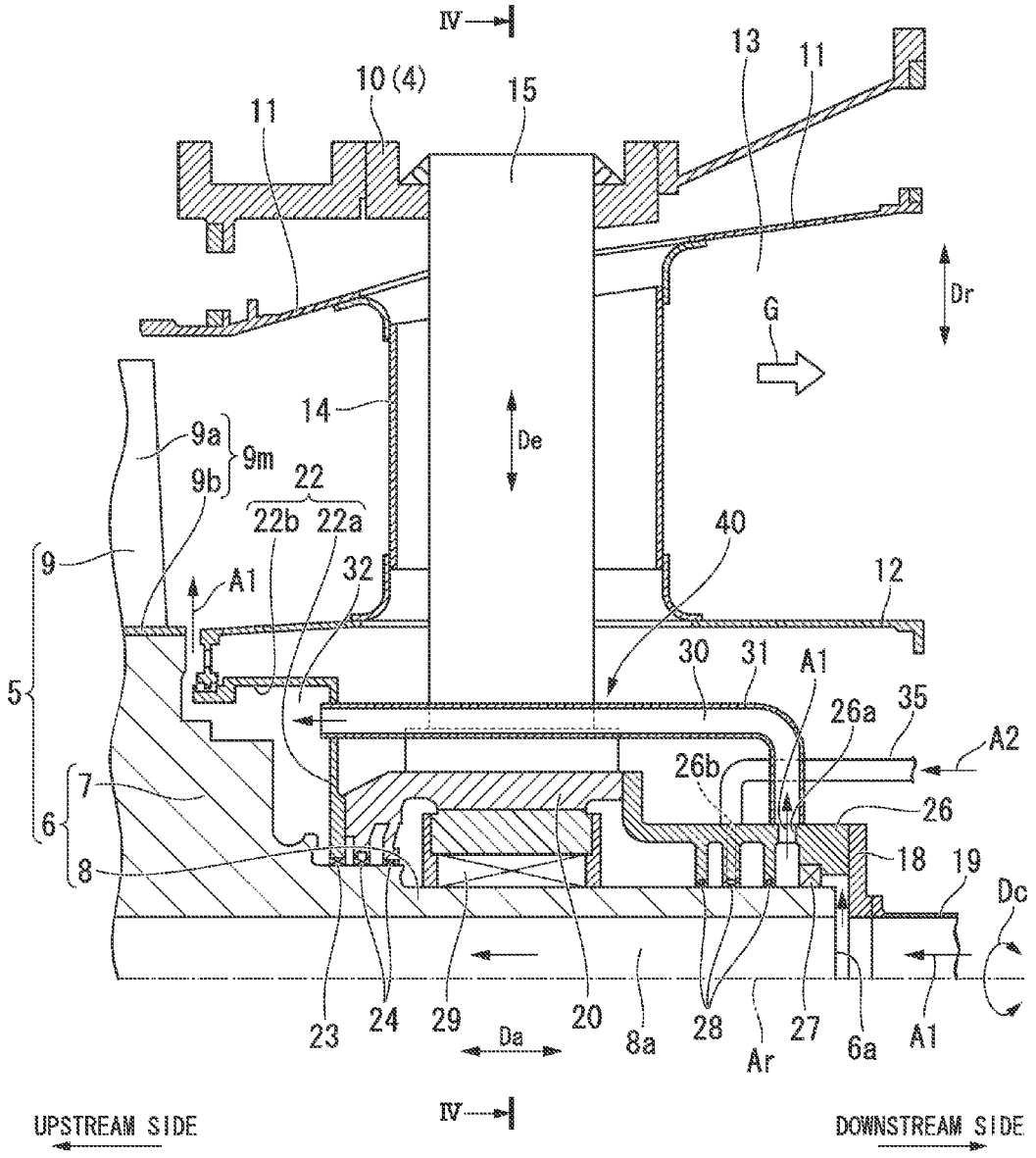
FIG. 2 is a cross-sectional view of the major parts of the gas turbine according to the embodiment of the present invention.

The turbine rotor 5 includes a rotor main body 6, and a plurality of blade stages 9. The rotor main body 6 extends around the rotation axis Ar in the axial direction Da. The plurality of blade stages 9 is fixed to an outer circumference of the rotor main body 6 to be arranged in the axial direction Da. The rotor main body 6 has a plurality of rotor discs 7, and a shaft section 8. The plurality of rotor discs 7 is arranged in the axial direction Da to be connected to each other. The shaft section 8 is fixed to the rotor disc 7 of the most downstream side and extends in the axial direction Da. One of the blade stages 9 is fixed to an outer circumference of one of the rotor discs 7. The blade stage 9 includes a plurality of blades 9*m* fixed side by side in a circumferential direction of the rotor disc 7. The blade 9*m* includes a blade main body 9*a*, a platform 9*b*, and a blade root. As shown in FIG. 2, the blade main body 9*a* extends in the radial direction Dr. The platform 9*b* is formed at an inner end in a radial direction of the blade main body 9*a*. The blade root (not shown) extends from the platform 9*b* inward in the radial direction. The blade root of the blade 9*m* is inserted into the rotor disc 7 to be fixed to the rotor disc 7. The shaft section 8 has a columnar shape around the rotation axis Ar, and is formed at a downstream side of the rotor disc 7 of the final stage.

The casing 4 has an exhaust chamber wall 10 having a cylindrical shape around the rotation axis Ar and disposed at a downstream side of the blade 9*m* of the final stage. An outer diffuser 11 and an inner diffuser 12 having a cylindrical shape around the rotation axis Ar are disposed at the inside of the exhaust chamber wall 10 in the radial direction. The outer diffuser 11 is installed along an inner circumferential surface of the exhaust chamber wall 10. The inner diffuser 12 is disposed at the inside of the outer diffuser 11 in the radial direction to be spaced apart therefrom. An exhaust flow passage 13 of a combustion gas G used to rotate the turbine rotor 5 is formed between the outer diffuser 11 and the inner diffuser 12.

A bearing 29 and a bearing box 20 are installed inside of the inner diffuser 12 in the radial direction. The bearing 29 rotatably supports the shaft section 8 of the turbine rotor 5. The bearing box 20 covers an outer circumferential side of the bearing 29 and supports the bearing 29. An upstream side seal retaining ring 22 is fixed to an upstream end of the bearing box 20, and a downstream side seal retaining ring 26 is fixed to a downstream end of the bearing box 20.

Figure 4:
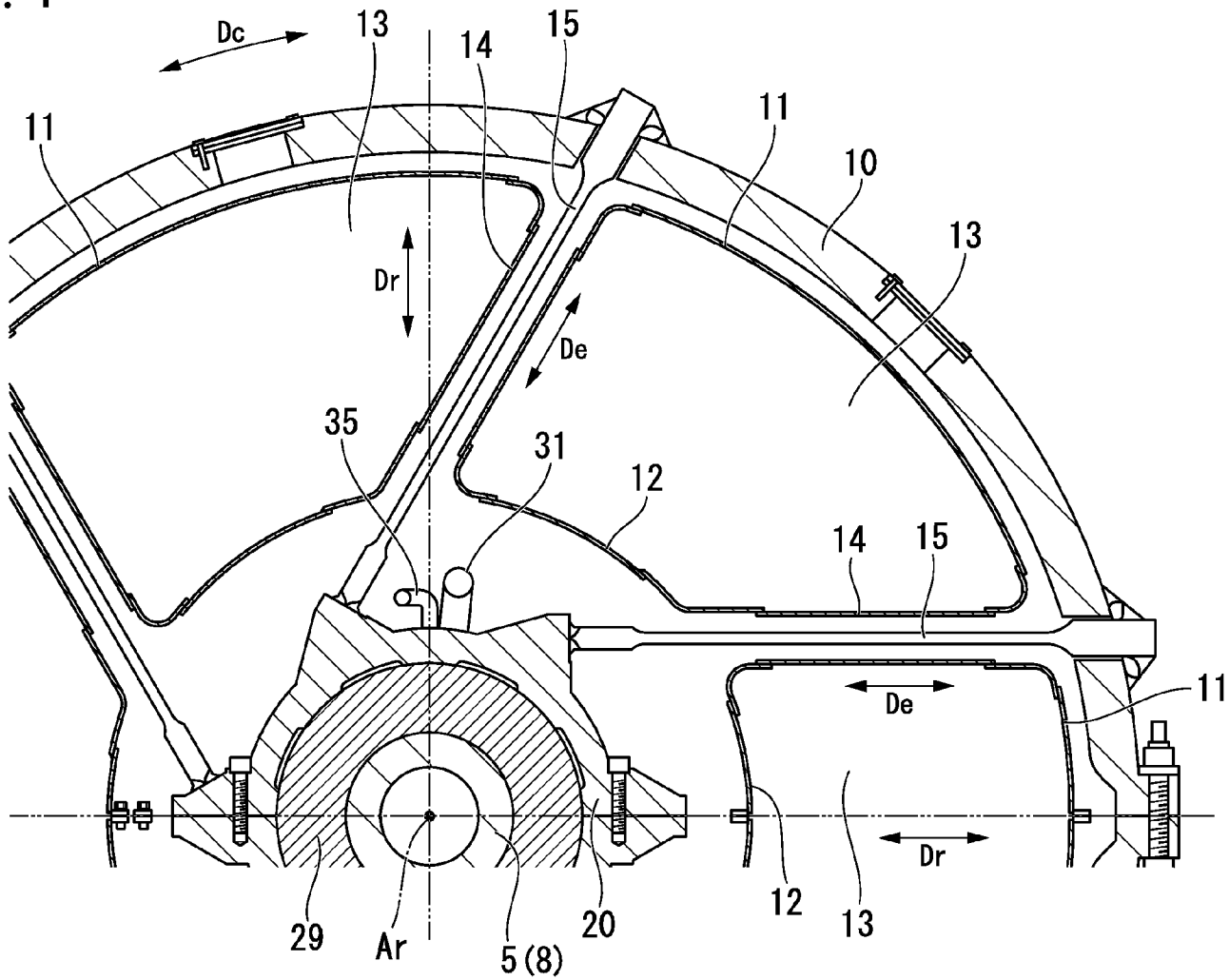
FIG. 4 is a cross-sectional view taken along line IV-IV of FIG. 2.

The exhaust chamber wall 10 and the bearing box 20 are connected by a strut 15 passing through the outer diffuser 11 and the inner diffuser 12. As shown in FIGS. 2 and 4, the strut 15 extends in a tangential direction of the turbine rotor 5 and is covered by a strut cover 14 in an extension direction De thereof. One end in the extension direction De of the strut cover 14 is provided with the outer diffuser 11, and the other end thereof is provided with the inner diffuser 12.

Figure 3:
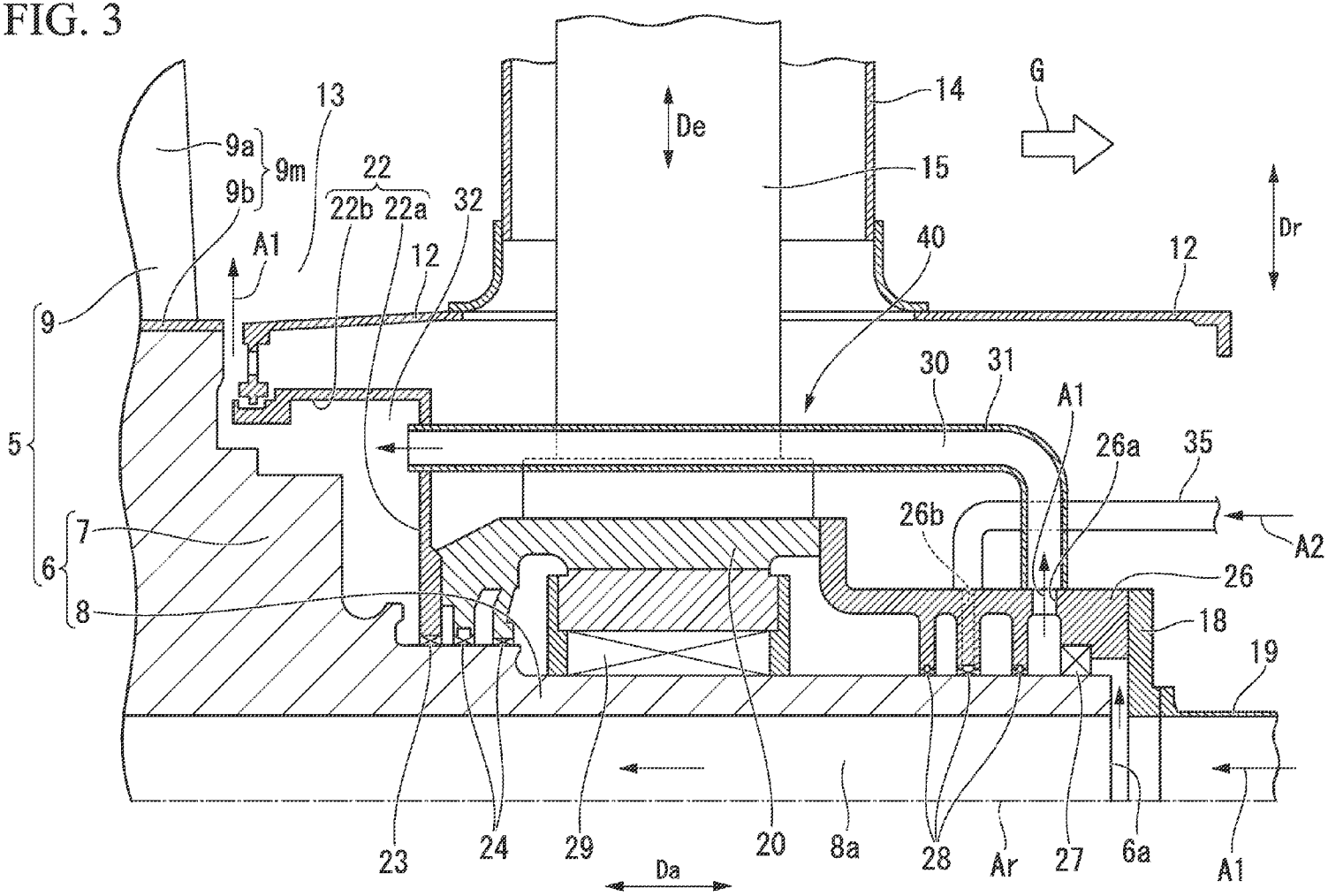
FIG. 3 is an enlarged view around a bearing of FIG. 2.

As shown in FIG. 3, a cooling air main passage 8*a* extending in the axial direction Da is formed at the rotor main body 6. The cooling air main passage 8*a* is opened at a downstream end of the rotor main body 6. A rotor sealing flange 18 spaced apart from the rotor main body 6 in the axial direction Da is disposed at a downstream end 6*a* of the rotor main body 6. The rotor sealing flange 18 is fixed to the downstream side seal retaining ring 26 at an outer circumferential side portion thereof. A cooling air pipe 19 is fixed to the rotor sealing flange 18. The cooling air pipe 19 is in communication with the cooling air main passage 8*a* of the turbine rotor 5.

The upstream side seal retaining ring 22 includes a seal holding section 22*a*, and a space partition section 22*b*. The seal holding section 22*a* having a disc shape around the rotation axis Ar is configured to be directed outward in the radial direction from the shaft section 8 of the turbine rotor 5 with a bearing upstream end shaft seal 23 interposed therebetween. The space partition section 22*b* having a cylindrical shape around the rotation axis Ar extends from an outer end of the seal holding section 22*a* in the radial direction toward an upstream side. The space partition section 22*b* having the cylindrical shape is disposed to have a space from the outer circumferential surface of the rotor main body 6 to the outside thereof in the radial direction, and is disposed to have a space from the inner circumferential surface of the inner diffuser 12 to the inside thereof in the radial direction. In addition, the upstream end of the space partition section 22*b* is disposed to have a space in the axial direction Da from the rotor disc 7 of the final stage. The bearing upstream end shaft seal 23 is installed inside of the seal holding section 22*a* of the upstream side seal retaining ring 22 in the radial direction. In addition, a plurality of bearing-side upstream side shaft seals 24 is installed inside of the upstream end of the bearing box 20 in the radial direction.

A space between the seal holding section 22*a* of the upstream side seal retaining ring 22 and the axial direction Da of the rotor disc 7 of the final stage and between the space partition section 22*b* of the upstream side seal retaining ring 22 and the outer circumferential side of the rotor main body 6 in the radial direction Dr is a leaked air discharge flow passage 32. The leaked air discharge flow passage 32 is connected with the exhaust flow passage 13 via a space between the downstream end of the platform 9*b* of the blade 9*m* of the final stage and the upstream end of the inner diffuser 12.

A plurality of bearing-side downstream side shaft seals 28 and a plurality of bearing downstream end shaft seals 27 are installed inside of the downstream side seal retaining ring 26 in the radial direction. The plurality of bearing-side downstream side shaft seals 28 is disposed at the bearing 29 side, that is, the upstream side of the bearing downstream end shaft seals 27. A first through-hole 26*a* passing from the inside in the radial direction to the outside in the radial direction is formed at the downstream side seal retaining ring 26 at a position in the axial direction Da between the plurality of bearing-side downstream side shaft seals 28 and the bearing downstream end shaft seals 27. In addition, a second through-hole 26*b* passing from the inside in the radial direction to the outside in the radial direction is formed at the downstream side seal retaining ring 26 at a position in the axial direction Da between the bearing-side downstream side shaft seal 28 of the most upstream side and the bearing-side downstream side shaft seal 28 of the most downstream side among the plurality of bearing-side downstream side shaft seals 28.

A first end of a leaked air collecting pipe 31 is connected to a position of the first through-hole 26*a* of the downstream side seal retaining ring 26. A second end of the leaked air collecting pipe 31 is connected to the seal holding section 22*a* of the upstream side seal retaining ring 22. The leaked air collecting pipe 31 is a pipe forming a flow passage configured to bring a flow passage in the first through-hole 26*a* of the downstream side seal retaining ring 26 in communication with the leaked air discharge flow passage 32. In the embodiment, a leaked air collecting flow passage 30 is formed by the flow passage in the first through-hole 26*a* of the downstream side seal retaining ring 26, a flow passage in the leaked air collecting pipe 31, and the leaked air discharge flow passage 32. Accordingly, a collecting flow passage member 40 configured to form the leaked air collecting flow passage 30 is constituted by the downstream side seal retaining ring 26 having the first through-hole 26*a*, the leaked air collecting pipe 31, and the turbine rotor 5 and the upstream side seal retaining ring 22 forming the leaked air discharge flow passage 32.

A first end of a shaft seal air pipe 35 is connected to a position of the second through-hole 26*b* of the downstream side seal retaining ring 26. A second end of the shaft seal air pipe 35 is connected to a shaft seal air supply source which is not shown.

Next, various air flows in the gas turbine as described above will be described with reference to FIG. 2.

For example, compressed air of several kg/cm$^2$ extracted from the compressor 1 at about 200° C. is supplied into the cooling air pipe 19 disposed at the downstream side of the turbine rotor 5 as cooling air A1. The cooling air A1 flows into the cooling air main passage 8*a* of the rotating turbine rotor 5, and further, cools the blade 9*m* and so on via a blade cooling air passage. In addition, shaft seal air A2 having a temperature and a pressure lower than the cooling air A1 extracted from the compressor 1 is supplied from a shaft seal air supply source to the shaft seal air pipe 35. The shaft seal air A2 is supplied from the second through-hole 26*b* of the downstream side seal retaining ring 26 to a position between an inner circumferential side of the downstream side seal retaining ring 26 and an outer circumferential side of the shaft section 8 of the turbine rotor 5 and between the bearing-side downstream side shaft seal 28 of the most upstream side and the bearing-side downstream side shaft seal 28 of the most downstream side. In addition, the shaft seal air A2 is used as sealing air between an inner circumferential side of the downstream side seal retaining ring 26 and an outer circumferential side of the shaft section 8 of the turbine rotor 5.

The cooling air pipe 19, the rotor sealing flange 18 to which the cooling air pipe 19 is fixed, and the downstream side seal retaining ring 26 fixed to the rotor sealing flange 18, which are not rotated, are not in contact with the rotating turbine rotor 5. For this reason, a portion of the cooling air A1 supplied into the cooling air main passage 8*a* of the turbine rotor 5 from the cooling air pipe 19 enters the outer circumferential side of the shaft section 8 from the downstream end of the shaft section 8 of the turbine rotor 5. The cooling air A1 has a sufficiently low temperature to cool the blade 9*m*, but a relatively high temperature for the bearing 29 of the turbine rotor 5. For this reason, when the bearing 29 of the turbine rotor 5 is exposed to the cooling air A1, the bearing 29 is heated, and for example, a trouble is caused such that oil in the bearing 29 is carbonized or the like.

Accordingly, in the embodiment, as the bearing downstream end shaft seals 27 are installed, the cooling air A1 entering the outer circumferential side of the shaft section 8 of the turbine rotor 5 is prevented from flowing to the bearing 29 side. However, as in the bearing downstream end shaft seals 27, a seal leakage occurs between the rotating body (the turbine rotor 5) and a stationary body due to imperfect sealing therebetween. For this reason, even in the embodiment, a portion of the cooling air A1 is leaked from the bearing downstream end shaft seals 27 to the bearing 29 side. When the cooling air A1 leaked from the bearing downstream end shaft seals 27 is simply discharged to the outside of the downstream side seal retaining ring 26 in the radial direction, the bearing 29 is heated by the cooling air A1 via the bearing box 20.

Here, in the embodiment, the leaked air collecting flow passage 30 connects the space, which is between the plurality of bearing-side downstream side shaft seals 28 and the bearing downstream end shaft seals 27, and the exhaust flow passage 13. The cooling air A1 leaked from the bearing downstream end shaft seals 27 to the bearing 29 side is discharged to the exhaust flow passage 13 through the leaked air collecting flow passage 30, the bearing box 20 and the bearing 29 are prevented from being heated by the leaked cooling air A1.

However, a pressure (a static pressure) at a position of the upstream side of the inner diffuser 12, which is the downstream side of the blade 9*m* of the final stage in the exhaust flow passage 13, i.e., an inlet section of the exhaust flow passage 13, is a slightly negative pressure. In the embodiment, the cooling air A1 leaked from the bearing downstream end shaft seals 27 to the bearing 29 side is discharged to the inlet section of the exhaust flow passage 13. For this reason, in the embodiment, in order to collect the cooling air A1 leaked from the bearing downstream end shaft seals 27 to the bearing 29 side, even when the pressure of the compressed air extracted from the compressor 1 as the cooling air A1 is not increased, since the pressure (the static pressure) of the inlet section of the exhaust flow passage 13 is a slightly negative pressure, the leaked cooling air A1 can be collected.

In addition, in the embodiment, since the cooling air A1 leaked from the bearing downstream end shaft seals 27 to the bearing 29 side is discharged into the exhaust flow passage 13 from the inside of the inner diffuser 12 in the radial direction, the leaked air collecting flow passage 30 can be reduced in length rather than the flow passage discharging the cooling air into the exhaust flow passage 13 from the outside of the outer diffuser 11 in the radial direction. For this reason, the leaked air collecting pipe 31 configured to form a portion of the leaked air collecting flow passage 30 can be reduced in length, and equipment cost can be suppressed. Further, as the leaked air collecting flow passage 30 is reduced in length, the pressure loss of the cooling air A1 passing through the flow passage 30 is reduced. For this reason, even when the pressure of the compressed air extracted from the compressor 1 as the cooling air A1 is not increased, the cooling air A1 leaked from the bearing downstream end shaft seals 27 can be collected.

In addition, while only one leaked air collecting pipe 31 and only one shaft seal air pipe 35 are shown in FIG. 4, a plurality of leaked air collecting pipes 31 and a plurality of shaft seal air pipes 35 may be installed in the circumferential direction.

INDUSTRIAL APPLICABILITY

In the present invention, it is possible to prevent the bearing from being heated by the compressed air extracted from the compressor as the cooling air.

DESCRIPTION OF REFERENCE NUMERALS

1 compressor
2 combustor
3 turbine
4 casing
5 turbine rotor
6 rotor main body
7 rotor disc
8 shaft section
8*a* cooling air main passage
9 blade stage
9*m* blade
10 exhaust chamber wall
11 outer diffuser
12 inner diffuser
13 exhaust flow passage
14 strut cover
15 strut
19 cooling air pipe
20 bearing box
22 upstream side seal retaining ring
23 bearing upstream end shaft seal
24 bearing-side upstream side shaft seal
26 downstream side seal retaining ring
26*a* first through-hole
26*b* second through-hole
27 bearing downstream end shaft seal
28 bearing-side downstream side shaft seal
29 bearing

30 leaked air collecting flow passage
31 leaked air collecting pipe
32 leaked air discharge flow passage
35 shaft seal air pipe
40 collecting flow passage member

What is claimed is:

1. A gas turbine including a rotor rotated around a rotation axis by a combustion gas, a bearing rotatably supporting a portion of a downstream side of the rotor, and a bearing box covering an outer circumferential side of the bearing and supporting the bearing, the gas turbine comprising:

a rotor main body provided in the rotor and extending in an axial direction parallel to the rotation axis around the rotation axis;

a plurality of blade stages provided in the rotor and fixed to an outer circumference of the rotor main body and arranged in the axial direction;

a cooling air main passage opened at a downstream end of the rotor main body and extending in the axial direction formed at the rotor main body;

a cooling air pipe disposed at a downstream side of the rotor main body without contacting with the rotor main body and configured to feed cooling air into the cooling air main passage of the rotor main body;

a downstream side seal retaining ring fixed to the bearing box and configured to cover a portion of the rotor main body at a downstream side of the bearing;

a bearing downstream end shaft seal annularly disposed at the outside of the rotor main body in a radial direction and at the downstream side of the bearing, and installed inside of the downstream side seal retaining ring in the radial direction;

a bearing-side downstream side shaft seal disposed at the downstream side of the bearing and the upstream side of the bearing downstream end shaft seal, and installed inside of the downstream side seal retaining ring in the radial direction; and a collecting flow passage member having a leaked air collecting flow passage that guides the cooling air, which reaches to the bearing downstream end shaft seal from a clearance between the downstream end of the rotor main body and the cooling air pipe via the outside of the rotor main body in the radial direction and is leaked from the bearing downstream end shaft seal to the bearing side, into an exhaust flow passage through which the combustion gas passing through the blade stage flows, wherein the downstream side seal retaining ring includes:

a first through-hole that is disposed at a position between the bearing downstream end shaft seal and the bearing-side downstream side shaft seal in the axial direction, and that penetrates through the downstream side seal retaining ring from the inside thereof in the radial direction to the outside thereof in the radial direction; and a second through-hole that is disposed at a position between the farthest downstream side of the bearing-side downstream side shaft seal and a downstream side of the bearing, and that penetrates through the downstream side seal retaining ring from the inside thereof in the radial direction to the outside thereof in the radial direction, and wherein a portion of the collecting flow passage member is connected to the first through-hole, and a shaft seal air pipe that supplies a shaft seal air from a shaft seal air supply source to the inside of the downstream side seal retaining ring in the radial direction is connected to the second through-hole.

2. The gas turbine according to claim 1, comprising:

an outer diffuser disposed at a downstream side of the final blade stage disposed at the farthest downstream side among the plurality of the blade stages and having a tubular shape around the rotation axis; and an inner diffuser having a tubular shape around the rotation axis and disposed at the inside of the outer diffuser in a radial direction and the outside of the rotor main body in a radial direction, so that the exhaust flow passage is formed between the outer diffuser and the inner diffuser, wherein the leaked air collecting flow passage guides the leaked cooling air from the inside in the radial direction of the inner diffuser into the exhaust flow passage.

3. The gas turbine according to claim 2, wherein the leaked air collecting flow passage guides the leaked cooling air to an upstream side of the inner diffuser.

4. The gas turbine according to claim 1, wherein the collecting flow passage member has a leaked air collecting pipe in which a flow passage in communication with the first through-hole of the downstream side seal retaining ring is formed.

* * * * *